US005648328A

United States Patent [19]

Angell et al.

[11] Patent Number: 5,648,328

[45] Date of Patent: Jul. 15, 1997

[54] PROCESS FOR PRODUCING A PARTICULATE LAUNDRY ADDITIVE COMPOSITION FOR PERFUME DELIVERY

[75] Inventors: Adrian J. W. Angell, West Chester; Athanasios Surutzidis, Hamilton; Frank A. Kvietok; David F. Perkis, both of Cincinnati, all of Ohio

[73] Assignee: The Procter & Gamble Company, Cincinnati, Ohio

[21] Appl. No.: 595,887

[22] Filed: Feb. 6, 1996

[51] Int. Cl.[6] ..... C11D 11/00; C11D 3/50; C11D 3/22

[52] U.S. Cl. ..... 510/441; 510/101; 510/349; 510/444; 510/446; 510/451; 510/470; 510/471; 510/473; 510/474

[58] Field of Search ..... 510/349, 101, 510/441, 470, 471, 444, 473, 474, 451, 446

[56] References Cited

U.S. PATENT DOCUMENTS

| | | | |
|---|---|---|---|
| 3,041,180 | 6/1962 | Swisher | 99/140 |
| 3,704,137 | 11/1972 | Beck | 99/140 R |
| 4,304,675 | 12/1981 | Corey et al. | 252/8.6 |
| 4,339,356 | 7/1982 | Whyte | 510/349 |
| 4,536,315 | 8/1985 | Ramachandran et al. | 252/174.11 |
| 4,539,135 | 9/1985 | Ramachandran et al. | 252/174.11 |
| 4,610,890 | 9/1986 | Miller et al. | 426/651 |
| 4,713,193 | 12/1987 | Tai | 252/91 |
| 4,842,761 | 6/1989 | Rutherford | 510/349 |
| 4,973,422 | 11/1990 | Schmidt | 510/349 |
| 5,009,900 | 4/1991 | Levine et al. | 426/96 |
| 5,236,615 | 8/1993 | Trinh et al. | 510/349 |
| 5,336,665 | 8/1994 | Garner-Gray et al. | 512/4 |

FOREIGN PATENT DOCUMENTS

| | | | |
|---|---|---|---|
| 0 535 942 A2 | 4/1993 | European Pat. Off. | C11D 3/00 |
| 0 536 942 A2 | 4/1993 | European Pat. Off. | A61K 7/46 |
| 137 599 | 9/1979 | Germany | C11D 206/798 |
| 248 508 | 8/1987 | Germany . | |
| 4-218583 | 8/1992 | Japan . | |
| 24 06 410 | 8/1975 | WIPO | C11D 1/00 |
| WO94/28107 | 6/1993 | WIPO | C11D 3/50 |
| WO94/06308 | 3/1994 | WIPO | A23L 1/22 |
| WO94/16046 | 7/1994 | WIPO | C11D 3/50 |
| WO94/19449 | 9/1994 | WIPO | C11D 17/00 |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for producing a particulate laundry additive composition produces a particulate laundry additive for perfume delivery in laundry detergent compositions, especially those in the form of granules or agglomerates. The process includes mixing a porous carrier material, typically containing perfume, and an encapsulating material, typically a carbohydrate material, to form agglomerates or an extrudate which is then sized into particles for incorporation into a detergent product. The process may be employed to produce particulate additive compositions which may be used in fabric softening and dishwashing as well as laundry detergent compositions.

15 Claims, 2 Drawing Sheets

PROCESS FOR PRODUCING A PARTICULATE LAUNDRY ADDITIVE COMPOSITION FOR PERFUME DELIVERY

FIELD OF THE INVENTION

The present invention generally relates to a process for producing a particulate laundry additive composition, and more particularly, to a process which produces a particulate laundry additive for perfume delivery in laundry detergent compositions, especially those in the form of granules, agglomerates, laundry bars or pastilles. The process of the invention may also be employed to produce particulate additive compositions which may be used in fabric softening and dishwashing as well as laundry detergent compositions.

BACKGROUND OF THE INVENTION

Most consumers have come to expect scented laundry products and to expect that fabrics which have been laundered also to have a pleasing fragrance. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. The detergent manufacturing industry, therefore, has long searched for an effective perfume delivery system for use in laundry products which provides long-lasting, storage-stable fragrance to the product, as well as fragrance to the laundered fabrics.

Laundry and other fabric care compositions which contain perfume mixed with or sprayed onto the compositions are well known in the art and currently commercialized. Because perfumes are made of a combination of volatile compounds, perfume can be continuously emitted from simple solutions and dry mixes to which the perfume has been added. Various techniques have been developed to hinder or delay the release of perfume from compositions so that they will remain aesthetically pleasing for a longer length of time. To date, however, few of the methods deliver significant fabric odor benefits after prolonged storage of the product.

Moreover, there has been a continuing search for methods and compositions which will effectively and efficiently deliver perfume from laundering solutions onto fabric surfaces. As can be seen from the following disclosures in the prior art, various methods of perfume delivery have been developed involving protection of the perfume through the wash cycle, with release of the perfume onto fabrics. For example, one method entails delivering fabric conditioning agents, including perfume, through the wash and dry cycle via a fatty quaternary ammonium salt. Another method involves a microencapsulation technique which involves the formulation of a shell material which will allow for diffusion of perfume out of the capsule only at certain temperatures. Yet another method involves incorporating perfume into waxy particles to protect the perfume through storage in dry compositions and through the laundry process. The perfume allegedly diffuses through the wax on the fabric in the dryer. Further prior art disclosures involve perfume dispersed with a water-insoluble nonpolymeric carrier material and encapsulated in a protective shell by coating with a water-insoluble friable coating material, and a perfume/cyclodextrin complex protected by clay which provides perfume benefits to at least partially wetted fabrics.

Still another method for delivery of perfume in the wash cycle involves combining the perfume with an emulsifier and water-soluble polymer, forming the mixture into particles, and adding them to a laundry composition. The perfume can also be adsorbed onto a porous carrier material, such as a polymeric material. Perfumes have also been adsorbed onto a clay or zeolite material which is then admixed into particulate detergent compositions. Generally, the preferred zeolites have been Type A or 4A Zeolites with a nominal pore size of approximately 4 Angstrom units. It is now believed that with Zeolite A or 4A, the perfume is adsorbed onto the zeolite surface with relatively little of the perfume actually absorbing into the zeolite pores.

While the adsorption of perfume onto zeolite or polymeric carriers may perhaps provide some improvement over the addition of neat perfume admixed with detergent compositions, industry is still searching for improvements in the length of storage time of the laundry compositions without loss of perfume characteristics, in the intensity or amount of fragrance delivered to fabrics, and in the duration of the perfume scent on the treated fabric surfaces. Furthermore, even with the substantial work done by prior skilled artisans in this area, a need still exists for a simple, more efficient and effective perfume delivery system, preferably in particulate form, which can be mixed with laundry compositions to provide initial and lasting perfume benefits to fabrics which have been treated with the laundry product.

Another problem associated with perfume delivery systems, especially those in particulate form, is concerned with the method by which such particulate perfume delivery systems are made. It has been difficult to produce perfume delivery systems particularly those involving zeolite or polymeric carriers in an economic and efficient manner. Oftentimes, a significant amount of the perfume will evaporate from the carrier material during processing as well as during storage prior to use. Additionally, many materials which are included in the perfume delivery system to prevent the volatilization of perfume prior to deposition on fabrics can degrade during manufacture, thereby losing its effectiveness. Thus, there has been a need for not only an effective perfume delivery system or additive for laundry detergents, but for a process which can produce such a laundry perfume delivery additive which is efficient, economical and minimizes the evaporation of perfume and degradation of materials used to minimize perfume evaporation during processing.

Accordingly, despite the aforementioned disclosures in the art, there remains a need for a process for producing a particulate laundry additive composition for perfume delivery in laundry detergent and other cleaning or fabric softening products. Additionally, there is a need for such a process which is not only more economical and efficient, but also minimizes the evaporation of perfume and the degradation of materials used in this regard during production.

BACKGROUND ART

U.S. Pat. No. 4,539,135, Ramachandran et al, issued Sep. 3, 1985, discloses particulate laundry compounds comprising a clay or zeolite material carrying perfume. U.S. Pat. No. 4,713,193, Tai, issued Dec. 15, 1987, discloses a free-flowing particulate detergent additive comprising a liquid or oily adjunct with a zeolite material. Japanese Patent HEI 4[1992]-218583, Nishishiro, published Aug. 10, 1992, discloses controlled-release materials including perfumes plus zeolites. U.S. Pat. No. 4,304,675, Corey et al, issued Dec. 8, 1981, teaches a method and composition comprising zeolites for deodorizing articles. East German Patent Publication No. 248,508, published Aug. 12, 1987; East German Patent Publication No. 137,599, published Sep. 12, 1979; European Patent Publication No. 535,942, published Apr. 7, 1993, and Publication No. 536,942, published Apr. 14, 1993, by Unilever PLC; U.S. Pat. No. 5,336,665, issued Aug. 9, 1994 to Garner-Gray et al.; and WO 94/28107, published Dec. 8, 1994.

SUMMARY OF THE INVENTION

The aforementioned needs in the art are met by the present invention which provides a process for producing a particulate laundry additive composition for perfume delivery primarily in laundry detergent and fabric softening products. The process essentially comprises the steps of thoroughly mixing an encapsulating material, preferably a glassy carbohydrate material, with a porous carrier particles, preferably loaded with a perfume, so as to form agglomerates or a hot extradate, and thereafter, grinding the agglomerates or extradate into particles. One critical step is to cool rapidly the agglomerates or extradate prior to the grinding step, thereby producing a laundry additive which, unexpectedly, contains perfume that has not evaporated or otherwise leached out of the carrier material are been de-natured during processing. In fact, as a result of this process, the perfume is sealed into the carrier material sufficiently to not permit exposure until subjected to the laundering or softening process.

As used herein, the term "agglomerates" refers to particles formed of the starting ingredients (liquid and/or particles) which typically have a smaller median particle size than the formed agglomerates. As used herein, the term "extrudate" refers to continuous phase material formed from an extruder which can have virtually any desired shape. As used herein, the term "enrobed" means that the carbohydrate material substantially covers the carrier particles regardless of the overall shape of the materials together, e.g. agglomerates, extrudate or particles. As used herein, the phrase "glass phase" or "glassy" materials refers to microscopically amorphous solid materials having a glass transition phase, $T_g$. As used herein, the phrase "continuous phase" refers to a single fused mass of individual or discrete particles. As used herein, the phrase "median particle size" means the "mean" particle size in that about 50% of the particles are larger and about 50% are smaller than this particle size as measured by standard sieve analysis.

All percentages and ratios used herein are expressed as percentages by weight (anhydrous basis) unless otherwise indicated. All documents are incorporated herein by reference.

In accordance with one aspect of the invention, a process for producing a particulate laundry additive composition is provided. This process comprises the steps of: (a) inputting an encapsulating material and porous carrier particles into a mixer, the porous carrier particles having a perfume adsorbed therein; (b) mixing the porous carrier particles and the encapsulating material so as to form agglomerates containing the porous carrier particles enrobed with the encapsulating material; (c) cooling the agglomerates; and (d) grinding the agglomerates to form particles having a predetermined particle size for addition into a detergent composition, thereby forming the particulate laundry additive composition.

In accordance with another aspect of the invention, another process for producing a particulate laundry additive composition is provided. This process comprises the steps of: (a) inputting a carbohydrate material and porous carrier particles into an extruder, the porous carrier particles having a perfume adsorbed therein; (b) extruding the porous carrier particles and the carbohydrate material so as to form an extrudate containing the porous carrier particles enrobed with the carbohydrate material; (c) cooling the extrudate; and (f) grinding the extrudate into particles, thereby forming the particulate laundry additive composition.

In still another aspect of the invention, a highly preferred process is provided. This process comprises the steps of: (a) inputting a molten carbohydrate material and porous carrier particles into a mixer, the porous carrier particles having a perfume adsorbed therein; (b) mixing the porous carrier particles and the carbohydrate material so as to form an extrudate containing the porous carrier particles enrobed with the carbohydrate material; (c) cooling the extrudate to be within a temperature range of from about 20° C. to about 100° C. within about 1 second to about 120 seconds; (d) grinding the extrudate into particles, (e) separating the particles into undersized particles and oversized particles, wherein the undersized particles have a median particle size of less than about 150 microns and the oversized particles have a median particle size of at least about 1100 microns; and (f) recycling the undersized particles back to the cooling step and recycling the oversized particles back to the grinding step so as to form the particulate laundry additive composition having a uniform particle size.

The present invention also provides the particulate laundry additive composition made according to any one of the processes described herein.

Accordingly, it is an object of the present invention to provide a process for producing a particulate laundry additive composition for perfume delivery in laundry detergent and other cleaning or fabric softening products. It is also an object of the invention to provide such a process which is more economical and efficient, and also minimizes the evaporation of perfume and the degradation of materials used in this regard during production. These and other objects, features and attendant advantages of the present invention will become apparent to those skilled in the art from a reading of the following derailed description of the preferred embodiment, drawings and the appended claims.

DETAILED DESCRIPTION OF THE PREFERRED EMBODIMENT

Process

The process of the invention unexpectedly provides a means by which a perfume-containing particulate laundry additive composition can be prepared without having excessive perfume evaporation or degradation during processing and which forms a particulate composition maintaining such perfume prior to its use during the laundering of fabrics. Additionally, the process unexpectedly prevents the encapsulating material used to enrobe the perfume-loaded carrier material from degradation during processing. Further, the process unexpectedly prevents the displacement of perfume from the porous carrier particles into the encapsulating material.

Figure 1:
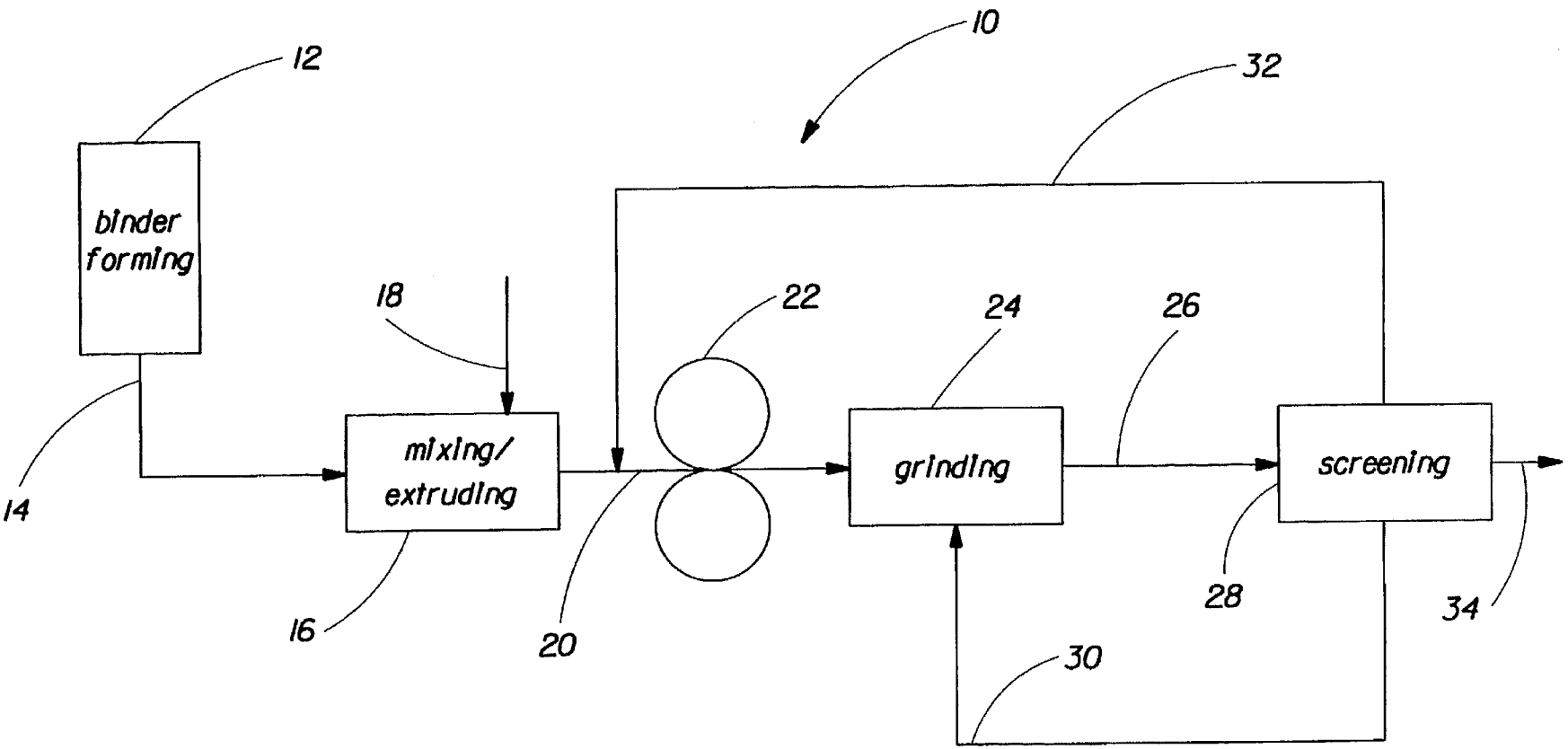
FIG. 1 is a schematic flow diagram of one embodiment of the process in which the undersized particle recycling step is completed by feeding the undersized particles back to just before the cooling step.

Turning now to FIG. 1 which provides a schematic flow diagram of one embodiment of the process 10, the first step of the process 10 involves inputting molten encapsulating material 14 from a binder forming apparatus 12 to a mixer/extruder 16. It should be understood that while mixer/extruder 16 can be mixing apparatus, it preferably is an extruder or similar apparatus. In the case of a mixer, agglomerates will be formed while extrusion apparatus will form an extrudate as described more fully hereinafter. The encapsulating material 14 preparation apparatus can be a Wiped Film Evaporator (WFE), or heated extruder, in the situation where the encapsulating material 14 is in the molten phase or a conventional spray-drying tower or similar apparatus when the encapsulating material 14 is in the solid phase. Preferably, the encapsulating material 14 is a carbohydrate material, which even more preferably, is in the glass phase.

Porous carrier particles or material 18 as described in detail hereinafter is added to the mixer/extruder 16, preferably near the end of the mixer/extruder 16. The mixer/extruder 16 can be any known mixing, extrusion, compounding or other apparatus, including but not limited to, extruders commercially available from APV Baker (CP Series), Werner & PFleiderer (Continuous and ZSK Series), Wenger (TF Series); Leistritz (ZSE Series), Buss (LR Series), Reiten Lausar (BT Series); Weber (DS Series), and Columbo (RC Series).

Preferably, the mixer/extruder 16 is maintained at a temperature of from about 50° C. to about 200° C., more preferably from about 110° C. to about 170° C., and most preferably from about 120° C. to about 160° C. In this way, adequate mixing of the porous carrier particles 18 and the encapsulating material 14 is ensured. The residence time of the porous carrier particles 18 and the encapsulating material 14 in the mixer/extruder 16 is preferably from about 0.1 minutes to about 10 minutes, more preferably from about 0.1 minutes to about 5 minutes, and most preferably from about 0.1 minutes to about 2 minutes. Optionally, the mixer/extruder 16 can be depressurized to a level of about 100 mm Hg to about 750 mm Hg, more preferably from about 450 mm Hg to about 735 mm Hg, and most preferably from about 710 mm Hg to about 550 mm Hg.

A hot extrudate or agglomerates 20 containing the porous carrier particles 18 enrobed with the encapsulating material 14 is formed in the mixer/extruder 16 and subjected to a cooling step in preferably a chilled roll/flaker 22 or similar apparatus. The cooling step preferably cools the extrudate or agglomerates 20 to a temperature in a range from about 20° C. to about 100° C., more preferably from about 20° C. to about 80° C., and most preferably from about 20° C. to about 60° C. Preferably, the cooling step is completed within about 1 second to about 120 seconds, more preferably from about 1 second to about 60 seconds, and most preferably from about 1 second to about 30 seconds.

The extrudate or agglomerates 20 are then subjected to a grinding step 24 which can be completed in any know grinding apparatus such as a hammermill. The resulting particles 26 are screened to provide particles 34 having a median particle size in a range from about 150 microns to about 1100 microns, more preferably from about 200 microns to about 800 microns, and more preferably from about 400 microns to about 600 microns.

Optionally, the process further comprises the step of screening or separating the particles 26 into undersized or "fines" and oversized or "overs" particles, wherein the undersized particles 32 have a median particle size of less than about 150 microns and the oversized particles 30 have a median particle size of at least 1100 microns. In this regard, the aforementioned undersized particles are recycled back to just before the cooling step or chilled roll/flaker 22, while the oversized particles are sent back to the grinding step 24. Past conventional wisdom by the skilled artisan would have recycled the oversized particles 30 and undersized particles 32 back to the mixer/extruder 16. However, the recycle steps described herein do not follow this scheme, but rather, recycle back to the cooling and/or grinding step as appropriate. These process steps unexpectedly result in minimized carbohydrate material and perfume degradation as the recycled particles are only subject to high temperatures for an extremely short period of time.

Figure 2:
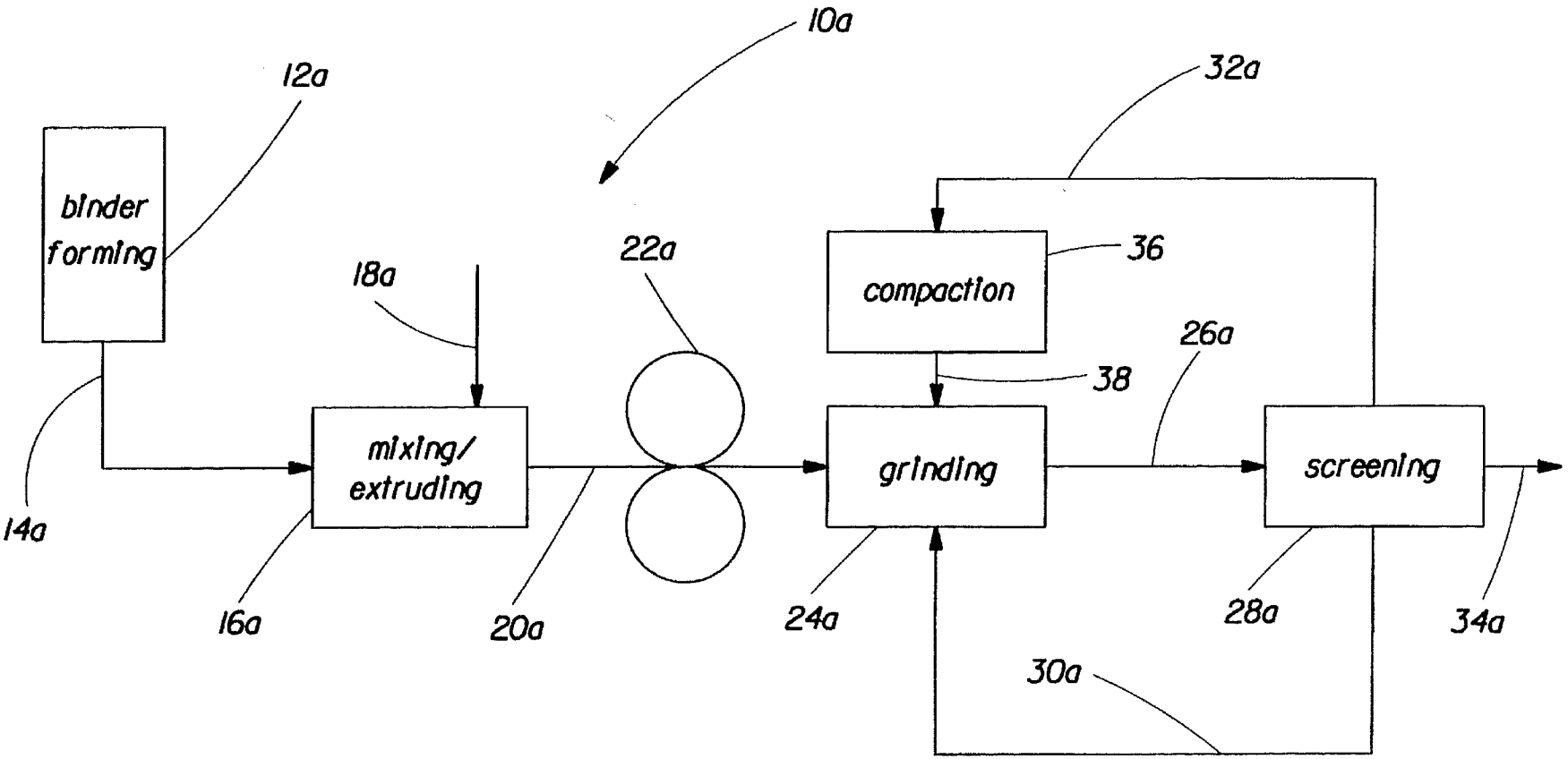
FIG. 2 is a schematic flow diagram of another embodiment of the process in which the recycling of undersized particles is completed by recycling the undersized particles back through a particle compactor.

Reference is now made to FIG. 2 which illustrates another embodiment of the process invention in which the process **10*a* has identical steps/apparatus 12*a* through 34*a* as process 10. Importantly, however, rather than recycling the undersized particles 32*a* back to just before the cooling step 22*a*, the process 10*a* subjects undersized particles 32*a* to a compaction step 36. The compaction step 36 produces particles 38 having a median particle size in a range from about 100 microns to about 100,000 microns, more preferably from about 200 microns to about 10,000 microns, and more preferably from about 250 microns to about 1,500 microns. These particles 38 are then fed to the grinding step 24*a***.

Particulate Laundry Additive Composition

The process invention produces a particulate laundry additive composition useful in the delivery of perfumes for laundering processes. The composition includes a carbohydrate material derived from one or more at least partially water-soluble hydroxylic compounds, wherein at least one of said hydroxylic compounds has an anhydrous, nonplasticized, glass transition temperature, Tg, of about 0° C. or higher, most preferably from about 40° C. to about 200° C. Further the carbohydrate material has a hygroscopicity value of less than about 80%. These perfume delivery compositions are especially useful in granular detergent compositions, particularly to deliver laundry and cleaning agents useful at low levels in the compositions.

The encapsulating materials useful herein are preferably selected from the following.

1. Carbohydrates, which can be any or mixture of: i) Simple sugars (or monosaccharides); ii) Oligosaccharides (defined as carbohydrate chains consisting of 2–10 monosaccharide molecules); iii) Polysaccharides (defined as carbohydrate chains consisting of at least 35 monosaccharide molecules); and iv) Starches.

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

In addition, the following classes of materials may be used as an adjunct with the carbohydrate or as a substitute.

2. All natural or synthetic gums such as alginate esters, carrageenan, agar-agar, pectic acid, and natural gums such as gum Arabic, gum tragacanth and gum karaya.

3. Chitin and chitosan.

4. Cellulose and cellulose derivatives. Examples include: i) Cellulose acetate and Cellulose acetate phthalate (CAP); ii) Hydroxypropyl Methyl Cellulose (HPMC); iii) Carboxymethylcellulose (CMC); iv) all enteric/aquateric coatings and mixtures thereof.

5. Silicates, Phosphates and Borates.

6. Polyvinyl alcohol (PVA).

7. Polyethylene glycol (PEG).

8. Nonionic surfactants including but not limited to polyhydroxy fatty acid amides.

Materials within these classes which are not at least partially water soluble and which have glass transition temperatures, Tg, below the lower limit herein of about 0° C. are useful herein only when mixed in such amounts with the hydroxylic compounds useful herein having the required higher Tg such that the particles produced has the required hygroscopicity value of less than about 80%.

Glass transition temperature, commonly abbreviated "Tg", is a well known and readily determined property for glassy materials. This transition is described as being equivalent to the liquification, upon heating through the Tg region, of a material in the glassy state to one in the liquid state. It is not a phase transition such as melting, vaporization, or sublimation. See William P. Brennan, "'What is a Tg?' A review of the scanning calorimetry of the glass transition", *Thermal Analysis Application Study #7*, Perkin-Elmer Corporation, March 1973 for further details. Measurement of Tg is readily obtained by using a Differential Scanning Calorimeter.

For purposes of the present invention, the Tg of the hydroxylic compounds is obtained for the anhydrous compound not containing any plasticizer (which will impact the measured Tg value of the hydroxylic compound). Glass transition temperature is also described in detail in P. Peyser, "Glass Transition Temperatures of Polymers", *Polymer Handbook, Third Edition*, J. Brandrup and E. H. Immergut (Wiley-Interscience; 1989), pp. VI/209–VI277.

At least one of the hydroxylic compounds useful in the present invention particulate compositions must have an.anhydrous, nonplasticized Tg of at least 0° C., and for particles not having a moisture barrier coating, at least about 20° C., preferably at least about 40° C., more preferably at least 60° C., and most preferably at least about 100° C. It is also preferred that these compounds be low temperature processable, preferably within the range of from about 40° C. to about 200° C., and more preferably within the range of from about 60° C. to about 160° C. Preferred such hydroxylic compounds include sucrose, glucose, lactose, and maltodextrin.

The "hygroscopicity value", as used herein, means the level of moisture uptake by the particulate compositions, as measured by the percent increase in weight of the particles under the following test method. The hygroscopicity value required for the present invention particulate compositions is determined by placing 2 grams of particles (approximately 500 micron size particles; not having any moisture barrier coating) in an open container petri dish under conditions of 90° F. and 80% relative humidity for a period of 4 weeks. The percent increase in weight of the particles at the end of this time is the particles hygroscopicity value as used herein. Preferred particles have hygroscopicity value of less than about 50%, more preferably less than about 10%.

The particulate compositions of the present invention typically comprise from about 10% to about 95% of the carbohydrate material, preferably from about 20% to about 90%, and more preferably from about 20% to about 75%. The particulate compositions of the present invention also typically comprise from about 0% to about 90% of agents useful for laundry or cleaning compositions, preferably from about 10% to about 80%, and more preferably from about 25% to about 80%.

Porous Carrier Particles

As used herein, "porous carrier particles" means any material capable of supporting (e.g., by absorption onto the surface or adsorption into pores) a perfume agent for incorporation into the particulate compositions. Such materials include porous solids selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof.

Preferred perfume carrier materials are zeolite X, zeolite Y and mixtures thereof. The term "zeolite" used herein refers to a crystalline aluminosilicate material. The structural formula of a zeolite is based on the crystal unit cell, the smallest unit of structure represented by $$Mm/n[(AlO2)m(SiO2)y].xH2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

The zeolite useful herein is a faujasite-type zeolite, including Type X Zeolite or Type Y Zeolite, both with a nominal pore size of about 8 Angstrom units, typically in the range of from about 7.4 to about 10 Angstrom units.

The aluminosilicate zeolite materials useful in the practice of this invention are commercially available. Methods for producing X and Y-type zeolites are well-known and available in standard texts. Preferred synthetic crystalline aluminosilicate materials useful herein are available under the designation Type X or Type Y.

For purposes of illustration and not by way of limitation, in a preferred embodiment, the crystalline aluminosilicate material is Type X and is selected from the following:

$$Na_{86}[AlO_2]_{86}.(SiO_2)_{106}].xH_2O, \quad (I)$$

$$K_{86}[AlO_2]_{86}.(SiO_2)_{106}].xH_2O, \quad (II)$$

$$Ca_{40}Na_6[AlO_2]_{86}.(SiO_2)_{106}].xH_2O, \quad (III)$$

$$Sr_{21}Ba_{22}[AlO_2]_{86}.(SiO_2)_{106}].xH_2O, \quad (IV)$$

and mixtures thereof, wherein x is from about 0 to about 276. Zeolites of Formula (I) and (II) have a nominal pore size or opening of 8.4 Angstroms units. Zeolites of Formula (III) and (IV) have a nominal pore size or opening of 8.0 Angstroms units.

In another preferred embodiment, the crystalline aluminosilicate material is Type Y and is selected from the following:

$$Na_{56}[AlO_2]_{56}.(SiO_2)_{136}].xH_2O, \quad (V)$$

$$K_{56}[AlO_{21}]_{56}.(SiO_2)_{136}].xH_2O, \quad (VI)$$

and mixture thereof, wherein x is from about 0 to about 276. Zeolites of Formula (V) and (VI) have a nominal pore size or opening of 8.0 Angstroms units.

Zeolites used in the present invention are in particle form having an average particle size from about 0.5 microns to about 120 microns, preferably from about 0.5 microns to about 30 microns, as measured by standard particle size analysis technique.

The size of the zeolite particles allows them to be entrained in the fabrics with which they come in contact. Once established on the fabric surface (with their coating matrix having been washed away during the laundry process), the zeolites can begin to release their incorporated laundry agents, especially when subjected to heat or humid conditions.

Incorporation of perfume in Zeolite—The Type X or Type Y Zeolites to be used herein preferably contain less than about 15% desorbable water, more preferably less than about 8% desorbable water, and most preferably less than about 5% desorbable water. Such materials may be obtained by first activating/dehydrating by heating to about 150° to 350° C., optionally with reduced pressure (from about 0.001 to about 20 Torr). After activation, the agent is slowly and thoroughly mixed with the activated zeolite and, optionally, heated to about 60° C. for up to about 2 hours to accelerate absorption equilibrium within the zeolite particles. The perfume/zeolite mixture is then cooled to room temperature and is in the form of a free-flowing powder.

The amount of laundry agent incorporated into the zeolite carrier is less than about 20%, typically less than about 18.5%, by weight of the loaded particle, given the limits on the pore volume of the zeolite. It is to be recognized, however, that the present invention particles may exceed this level of laundry agent by weight of the particle, but recognizing that excess levels of laundry agents will not be incorporated into the zeolite, even if only deliverable agents are used. Therefore, the present invention particles may comprise more than 20% by weight of laundry agents. Since any excess laundry agents (as well as any non-deliverable agents present) are not incorporated into the zeolite pores, these materials are likely to be immediately released to the wash solution upon contact with the aqueous wash medium.

In addition to its function of containing/protecting the perfume in the zeolite particles, the carbohydrate material also conveniently serves to agglomerate multiple perfumed zeolite particles into agglomerates having an overall particles size in the range of 200 to 1000 microns, preferably 400 to 600 microns. This reduces dustiness. Moreover, it lessens the tendency of the smaller, individual perfumed zeolites to sift to the bottom of containers filled with granular detergents, which, themselves, typically have particle sizes in the range of 200 to 1000 microns.

Perfume

As used herein the term "perfume" is used to indicate any odoriferous material which is subsequently released into the aqueous bath and/or onto fabrics contacted therewith. The perfume will most often be liquid at ambient temperatures. A wide variety of chemicals are known for perfume uses, including materials such as aldehydes, ketones and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

Perfumes also include pro-fragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g., pH drop) or may be enzymatically releasable pro-fragrances.

Preferred perfume agents useful herein are defined as follows.

For purposes of the present invention compositions exposed to the aqueous medium of the laundry wash process, several characteristic parameters of perfume molecules are important to identify and define: their longest and widest measures; cross sectional area; molecular volume; and molecular surface area. These values are calculated for individual perfume molecules using the CHEMX program (from Chemical Design, Ltd.) for molecules in a minimum energy conformation as determined by the standard geometry optimized in CHEMX and using standard atomic van der Waal radii. Definitions of the parameters are as follows:

"Longest": the greatest distance (in Angstroms) between atoms in the molecule augmented by their van der Waal radii.

"Widest": the greatest distance (in Angstroms) between atoms in the molecule augmented by their van der Waal radii in the projection of the molecule on a plane perpendicular to the "longest" axis of the molecule.

"Cross Sectional Area": area (in square Angstrom units) filled by the projection of the molecule in the plane perpendicular to the longest axis.

"Molecular Volume": the volume (in cubic Angstrom units) filled by the molecule in its minimum energy configuration.

"Molecular Surface Area": arbitrary units that scale as square Angstroms (for calibration purposes, the molecules methyl beta naphthyl ketone, benzyl salicylate, and camphor gum have surface areas measuring 128±3, 163.5±3, and 122.5±3 units respectively).

The shape of the molecule is also important for incorporation. For example, a symmetric perfectly spherical molecule that is small enough to be included into the zeolite channels has no preferred orientation and is incorporated from any approach direction. However, for molecules that have a length that exceeds the pore dimension, there is a preferred "approach orientation" for inclusion. Calculation of a molecule's volume/surface area ratio is used herein to express the "shape index" for a molecule. The higher the value, the more spherical the molecule.

For purposes of the present invention, perfume agents are classified according to their ability to be incorporated into zeolite pores, and hence their utility as components for delivery from the zeolite carrier through an aqueous environment. Plotting these agents in a volume/surface area ratio vs. cross sectional area plane permits convenient classification of the agents in groups according to their incorporability into zeolite. In particular, for the zeolite X and Y carriers according to the present invention, agents are incorporated if they fall below the line (herein referred to as the "incorporation line") defined by the equation:

$$y=-0.01068x+1.497$$

where x is cross sectional area and y is volume/surface area ratio. Agents that fall below the incorporation line are referred to herein as "deliverable agents"; those agents that fall above the line are referred to herein as "non-deliverable agents".

For containment through the wash, deliverable agents are retained in the zeolite carrier as a function of their affinity for the carrier relative to competing deliverable agents. Affinity is impacted by the molecule's size, hydrophibicity, functionality, volatility, etc., and can be effected via interaction between deliverable agents within the zeolite carrier. These interactions permit improved through the wash containment for the deliverable agents mixture incorporated. Specifically, for the present invention, the use of deliverable agents having at least one dimension that is closely matched to the zeolite carrier pore dimension slows the loss of other deliverable agents in the aqueous wash environment. Deliverable agents that function in this manner are referred to herein as "blocker agents", and are defined herein in the volume/surface area ratio vs. cross sectional area plane as those deliverable agent molecules falling below the "incorporation line" (as defined hereinbefore) but above the line (herein referred to as the "blocker line") defined by the equation:

$$y=-0.01325x+1.46$$

where x is cross sectional area and y is volume/surface area ratio.

For the present invention compositions which utilize zeolite X and Y as the carriers, all deliverable agents below the "incorporation line" can be delivered and released from the present invention compositions, with the preferred materials being those falling below the "blocker line". Also preferred are mixtures of blocker agents and other deliverable agents. Laundry perfume agent mixtures useful for the present invention laundry particles preferably comprise from about 5% to about 100% (preferably from about 25% to about 100%; more preferably from about 50% to about 100%) deliverable agents; and preferably comprising from about 0.1% to about 100% (preferably from about 0.1% to about 50%) blocker agents, by weight of the laundry agents mixture.

Obviously for the present invention compositions whereby perfume agents are being delivered by the compositions, sensory perception is required for a benefit to be seen by the consumer. For the present invention perfume compositions, the most preferred perfume agents useful herein have a threshold of noticability (measured as odor detection thresholds ("ODT") under carefully controlled GC conditions as described in detail hereinafter) less than or equal to 10 parts per billion ("ppb"). Agents with ODTs between 10 ppb and 1 part per million ("ppm") are less preferred. Agents with ODTs above 1 ppm are preferably avoided. Laundry agent perfume mixtures useful for the present invention laundry particles preferably comprise from about 0% to about 80% of deliverable agents with ODTs between 10 ppb and 1 ppm, and from about 20% to about 100% (preferably from about 30% to about 100%; more preferably from about 50% to about 100%) of deliverable agents with ODTs less than or equal to 10 ppb.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300 C. Laundry agent perfume mixtures useful for the present invention laundry particles preferably comprise at least about 50% of deliverable agents with boiling point less than 300 C. (preferably at least about 60%; more preferably at least about 70%).

In addition, preferred laundry particles herein comprise compositions wherein at least about 80%, and more preferably at least about 90%, of the deliverable agents have a "ClogP value" greater than about 1.0. ClogP values are obtained as follows.

Calculation of ClogP:

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, logP.

The logP of many perfume ingredients has been reported; for example, the Pomona92 database, available from Daylight Chemical Information Systems, Inc. (Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The ClogP values, which are the most reliable and widely used estimates for this physicochemical property, can be used instead of the experimental logP values in the selection of perfume ingredients.

Determination of Odor Detection Thresholds:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.2 minutes, the sampled volume is calculated. Since the precise concentration at the detector at any point in time is known, the mass per volume inhaled is known and hence the concentration of material. To determine whether a material has a threshold below 10 ppb, solutions are delivered to the sniff port at the back-calculated concentration. A panelist sniffs the GC effluent and identifies the retention time when odor is noticed. The average over all panelists determines the threshold of noticeability.

The necessary amount of analyte is injected onto the column to achieve a 10 ppb concentration at the detector. Typical gas chromatograph parameters for determining odor detection thresholds are listed below.

GC: 5890 Series II with FID detector 7673 Autosampler
Column: J&W Scientific DB-1 Length 30 meters ID 0.25 mm film thickness 1 micron
Method:
Split Injection: 17/1 split ratio
Autosampler: 1.13 microliters per injection
Column Flow: 1.10 mL/minute
Air Flow: 345 mL/minute
Inlet Temp. 245° C.
Detector Temp. 285° C.
Temperature Information
Initial Temperature: 50° C.
Rate: 5 C./minute
Final Temperature: 280° C.
Final Time: 6 minutes Leading assumptions: 0.02 minutes per sniff
GC air adds to sample dilution
Perfume Fixative:

Optionally, the perfume can be combined with a perfume fixative. The perfume fixative materials employed herein are characterized by several criteria which make them especially suitable in the practice of this invention. Dispersible, toxicologically-acceptable, non-skin irritating, inert to the perfume, degradable and/or available from renewable resources, and relatively odorless additives are used. Perfume fixatives are believed to slow the evaporation of more volatile components of the perfume.

Examples of suitable fixatives include members selected from the group consisting of diethyl phthalate, musks, and mixtures thereof. If used, the perfume fixative comprises from about 10% to abut 50%, preferably from about 20% to about 40%, by weight, of the perfume.

Adjunct Laundry or Cleaning Ingredients

Adjunct ingredients useful for in or with the laundry or cleaning particulate compositions according to the present invention are selected from the group consisting of surfactants, perfumes, bleaches, bleach promoters, bleach activators, bleach catalysts, chelants, antiscalants, threshold inhibitors, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof. As can be appreciated for the present invention, these agents useful for laundry or cleaning compositions which are incorporated into the particulate compositions of the present invention may be the same as or different from those agents which are used to formulate the remainder of the laundry and cleaning compositions containing the particulate compositions produced by the instant process. For example, the particulate compositions may comprise a perfume agent and the same or different agent may also be blended into the final composition along with the perfume-containing particulate composition. These agents are selected as desired for the type of composition being formulated, such as granular laundry detergent compositions, granular automatic dishwashing compositions, or hard surface cleaners.

The various types of agents useful in laundry and cleaning compositions are described hereinafter. The compositions containing particulate compositions can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.).

Detersive Surfactant

The granules and/or the agglomerates include surfactants at the levels stated previously. The detersive surfactant can be selected from the group consisting of anionic suffactants, nonionic surfactants, cationic suffactants, zwitterionic suffactants and mixtures. Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^- M^+)CH_3$ and $CH_3(CH_2)_y(CHOSO_3^{-M+})CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The $C_{10}$–$C_{18}$ alkyl alkoxy sulfates ("$AE_xS$"; especially EO 1–7 ethoxy sulfates) and $C_{12}$–$C_{18}$ alkyl ethoxylates ("AE") are the most preferred for the cellulase-containing detergents described herein.

Detersive Builder

The granules and agglomerates preferably include a builder at the previously stated levels. To that end, inorganic as well as organic builders can be used. Also, crystalline as well as amorphous builder materials can be used. Builders are typically used in fabric laundering compositions to assist in the removal of particulate soils.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "under built" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973. As mentioned previously, aluminosilicate builders are useful builders in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitriliotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with aeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Enzymes

One such adjunct ingredient are enzymes which can be included formulations herein for a wide variety of fabric laundering purposes, including removal of protein-based, carbohydrate-based, or triglyceride-based stains, for example, and for the prevention of refugee dye transfer, and for fabric restoration. The additional enzymes to be incorporated include cellulases, proteases, amylases, lipases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders as well as their potential to cause malodors during use. In this respect bacterial or fungal enzymes are preferred, such as bacterial amylases and proteases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

The cellulase suitable for the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*), suitable cellulases are also disclosed in GB-A-2.075.028; GB-A-2.095.275 and DE-OS-2.247.832. In addition, cellulase especially suitable for use herein are disclosed in WO 92-13057 (Procter & Gamble). Most preferably, the cellulases used in the instant detergent compositions are purchased commercially from NOVO Industries A/S under the product names CAREZYME® and CELLUZYME®.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Typical granular or powdered detergents can be stabilized effectively by using enzyme granulates. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii)

poly(vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6 , as disclosed in U.S. Pat. No. 4,721,580, issued January 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarlyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isothionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Suds Suppressors

Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain nonsuffactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and halo paraffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffin and cyclic hydrocarbons.

Another preferred category of non-suffactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing mount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Dye Transfer Inhibitors

The composition of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R-$A_x$-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

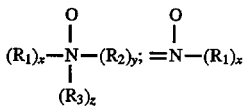

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which has an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modem Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

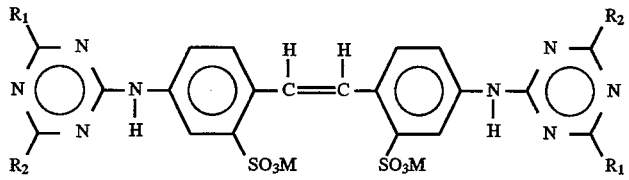

wherein $R_1$ is selected from aniline, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is aniline, $R_2$ is N-2-bis-hydroxyethyl and M is a cation such as sodium, the brightener is 4,4',-bis[(4-aniliono-6-(N-2-bis-hydroxyethyl)-s-triazine-2-yl)amino]-2,2'-stilbenedisulfonic acid and disodium salt. This particular brightener species is commercially marketed under the trade name Tinopal-UNPA-GX by Ciba-Geigy Corporation. Tinopal-UNPA-GX is the preferred hydrophilic optical brightener useful in the detergent compositions herein.

When in the above formula, $R_1$ is aniline, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the trade name Tinopal 5BM-GX by Ciba-Geigy Corporation.

When in the above formula, $R_1$ is aniline, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the trade name Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal 30 AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Other Adjunct Ingredients

The detergent composition may also include enzyme stabilizers, brighteners, polymeric dispersing agents (i.e. polyacrylates), carriers, hydrotropes, suds boosters, processing aids, dyes or pigments, and perfumes.

EXAMPLE I

A dried carbohydrate powder having a dextrose equivalence of 62, and a moisture level of 2.6%, and zeolite X incorporating 16% perfume by weight, were added at a ratio of 1:1 into a 12 barrel, Werner & Pfieiderer™ ZSK 30 twin screw extruder (TSE) without a constricting die plate. Barrels 1 through 4 of the TSE were maintained at a temperature of 80° C., barrels 5 and 6 were maintained at a temperature of 90 deg C., barrels 7 and 8 were maintained at a temperature of 130° C., barrels 9 and 10 were maintained at a temperature of 135° C. and barrels 11 and 12 were maintained at a temperature of 130° C. The powdered carbohydrate is converted to a molten state in barrels 1 through 10. Excess moisture is removed in barrels 5 and 8 via vacuum at a pressure of 5 mm Hg. The perfume loaded zeolite is added in barrel 11 and intimately mixed with the molten carbohydrate prior to leaving the TSE at a product discharge temperature of 145° C. and a rate of 500 g/min. The product is cooled at room temperature to form a solid. The solid is ground in a Fitz Mill™ (available from The Fitzpatrick Company) and sized via screening. The particles formed unexpectedly have excellent stability and performance properties.

EXAMPLE II

In this Example, a solution of 82% solid carbohydrate material (having a dextrose equivalence of 62) and the balance water was dried to form a solid carbohydrate glassy material in a Luna™ Wiped Film Evaporator (WFE). The molten carbohydrate having a dextrose equivalence of 62, and a moisture level of 2.0%, and zeolite X incorporating 16% perfume by weight were added at a ratio of 1:1 into a 12 barrel, Werner & Pfieiderer™ ZSK 30 twin screw extruder (TSE) without a constricting die plate. Barrels 1 through 4 of the TSE were maintained at a temperature of 80° C., barrels 5 and 6 were maintained at a temperature of 90° C., barrels 7 and 8 were maintained at a temperature of 130° C., barrels 9 and 10 were maintained at a temperature of 135° C. and barrels 11 and 12 were maintained at a temperature of 130° C. The molten carbohydrate is fed at a temperature of 160° C. to the TSE in Barrel 7. The perfume loaded zeolite is added in barrel 11 and intimately mixed with the molten carbohydrate prior to leaving the TSE at a product discharge temperature of 150° C. and a rate of 500 g/min. The product is cooled at room temperature to form a solid. The solid is ground in a Fitz Mill™ (available from The Fitzpatrick Company) and sized via screening. The particles formed unexpectedly have excellent stability and performance properties.

EXAMPLE III

This Example follows the same protocol as Example I, except as the material leaves the TSE it enters a chill roll flaker to form crisp flakes having low stickiness. These flakes are ground in a Fitz Mill™ (available from The Fitzpatrick Company) and sized via screening. The particles formed have excellent stability and performance properties.

Having thus described the invention in detail, it will be clear to those skilled in the art that various changes may be made without departing from the scope of the invention and the invention is not to be considered limited to what is described in the specification.

What is claimed is:

1. A process for producing a particulate laundry additive composition comprising the steps of:

(a) inputting an encapsulating material and porous carrier particles into a mixer, said porous carrier particles having a perfume adsorbed therein;

(b) mixing said porous carrier particles and said encapsulating material so as to form agglomerates containing said porous carrier particles enrobed with said encapsulating material;

(c) cooling said agglomerates to be within a temperature range of from about 20° C. to about 100° C. within about 1 second to about 120 seconds;

(d) grinding said agglomerates to form particles;

(e) separating said particles into undersized particles and oversized particles, wherein said undersized particles have a median particle size of less than about 150 microns and said oversized particles have a median particle size of at least about 1100 microns; and (f) recycling said undersized particles back to said cooling step and recycling said oversize particle back to said grinding step, the remaining particles thereby forming said particulate laundry additive composition.

2. The process of claim 1 wherein the residence time of said porous carrier particles and said encapsulating material in said mixer is from about 0.05 minutes to about 10 minutes.

3. The process of claim 1 further comprising the step of maintaining the temperature of said mixer between about 100° C. to about 200° C.

4. The process of claim 1 further comprising the step of depressurizing said mixer to from about 100 mm Hg to about 750 mm Hg.

5. The process of claim 1 further comprising the step of compacting said undersized particles to form compacted particles which are recycled back to said grinding step.

6. The process of claim 1 wherein said porous carrier particles are selected from the group consisting of amorphous silicates, crystalline nonlayered silicates, layered silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof; and said porous carrier particles have a surface area of at least about 50 $m^2/g$.

7. The process of claim 1 wherein said porous carrier particles are selected from the group consisting of Zeolite X, Zeolite Y, and mixtures thereof.

8. The process of claim 1 wherein said encapsulating material is in the glass phase and has a glass transition temperature in the range of from about 30° C. to about 200° C.

9. The process of claim 1 wherein said encapsulating material is selected from starches, polysaccharides, oligosaccharides, disaccharides, monosaccharides, alginate esters, carrageenan, agar-agar, pectic acid, chitosan, chitin, cellulose acetate cellulose acetate phthalate, carboxymethylcellulose, silicates, phosphates, borates, polyethylene glycols, polyvinyl alcohol, nonionic suffactants and mixtures thereof.

10. The process of claim 1 wherein said encapsulating material in said inputting step is in the molten phase.

11. A process for producing a particulate laundry additive composition comprising the steps of:

(a) inputting a carbohydrate material and porous carrier particles into an extruder, said porous carrier particles having a perfume adsorbed therein;

(b) extruding said porous carrier particles and said carbohydrate material so as to form an extrudate containing said porous carrier particles enrobed with said carbohydrate material;

(c) cooling said extrudate to be within a temperature range of from about 20° C. to about 100° C. within about 1 second to about 120 seconds;

(f) grinding said extrudate into particles;

(e) separating said particles into undersized particles and oversized particles, wherein said undersized particles have a median particle size of less than about 150 microns and said oversized particles have a median particle size of at least about 1100 microns; and (f) recycling said undersized particles back to said cooling step and recycling said oversized particles back to said grinding step, the remaining particles thereby forming said particulate laundry additive composition.

12. The process of claim 11 wherein said carbohydrate material in said inputting step is in the molten phase.

13. The process of claim 11 wherein the residence time of said porous carrier particles and said carbohydrate material in said extruder is from about 0.1 minutes to about 10 minutes.

14. The process of claim 11 further comprising the step of depressurizing said extruder to about 100 mm Hg to about 750 mm Hg.

15. The process of claim 11 further comprising the step of compacting said undersized particles to form compacted particles which are recycled back to said grinding step.

* * * * *